United States Patent [19]

Seidl

[11] Patent Number: 4,711,203

[45] Date of Patent: Dec. 8, 1987

[54] TIMING CASE FOR A CYLINDER HEAD OF INTERNAL COMBUSTION ENGINES HAVING GAS CHANGING VALVES ARRANGED ESSENTIALLY IN PARALLEL TO ONE ANOTHER

[75] Inventor: Jiri Seidl, Munich, Fed. Rep. of Germany

[73] Assignee: Bayerische Motoren Werke AG, Munich, Fed. Rep. of Germany

[21] Appl. No.: 874,163

[22] PCT Filed: Oct. 5, 1985

[86] PCT No.: PCT/EP85/00521

§ 371 Date: Jun. 12, 1986

§ 102(e) Date: Jun. 12, 1986

[87] PCT Pub. No.: WO86/02700

PCT Pub. Date: May 9, 1986

[30] Foreign Application Priority Data

Oct. 29, 1984 [DE] Fed. Rep. of Germany ..... 3439553

[51] Int. Cl.[4] ..... F01M 1/06

[52] U.S. Cl. ..... 123/90.34; 123/90.6; 123/193 H; 123/196 R

[58] Field of Search ..... 123/90.6, 90.33, 90.27, 123/193 H, 90.34, 196 R; 184/6.9

[56] References Cited

U.S. PATENT DOCUMENTS

| | | | |
|---|---|---|---|
| 2,209,496 | 7/1940 | Watson | 123/90.6 |
| 2,674,904 | 4/1954 | Dickson | 123/90.34 |
| 3,080,704 | 3/1963 | Nallinger | 123/90.17 |
| 3,301,239 | 1/1967 | Thauer | 123/90.52 |
| 3,306,271 | 2/1967 | Turlay | 123/90.39 |
| 3,482,555 | 12/1969 | Sherbinsky et al. | 123/90.41 |
| 3,672,338 | 6/1972 | Yamanouchi | 123/90.27 |
| 3,958,541 | 5/1976 | Lachnit | 123/90.34 |
| 4,448,155 | 5/1984 | Hillebrand et al. | 123/90.48 |
| 4,565,168 | 1/1986 | Rivere | 123/90.34 |
| 4,606,304 | 8/1986 | Kruger et al. | 123/90.34 |

FOREIGN PATENT DOCUMENTS

| | | | |
|---|---|---|---|
| 2342530 | 5/1974 | Fed. Rep. of Germany . | |
| 3009302 | 9/1980 | Fed. Rep. of Germany . | |
| 0162216 | 12/1981 | Japan | 123/90.6 |
| 7018294 | 6/1972 | Netherlands . | |
| 5476 | of 1911 | United Kingdom | 123/90.39 |

*Primary Examiner*—Craig A. Feinberg
*Assistant Examiner*—David A. Okonsky
*Attorney, Agent, or Firm*—Barnes & Thornburg

[57] ABSTRACT

A timing case, for a cylinder head of an internal combustion engine having gas changing valves arranged essentially in parallel to one another, wherein the guiding of a camshaft 7, the timing case also has a divided bearing 8, the bottom part 8' of which is connected to a web 11 between breakthroughs 2, 3 provided for the guiding of the tappets 4 such that, in the case of narrowly adjacent breakthroughs 2,3, during the manufacturing, a cutting of the bearing bore 9 in the lower part 8' of the bearing is avoided with the result of a reduced bearing surface 12, the web 11, such that a wall thickness "s" that is smaller than the width "x" of the bearing 8, ends at such a distance "y" from the bearing surface 12 of the bearing bore 9 that a bearing wall 9' remains on both sides of the web 11 that has the bearing surface 12, the bearing wall 9' being connected with said web 11 in one piece.

7 Claims, 3 Drawing Figures

TIMING CASE FOR A CYLINDER HEAD OF INTERNAL COMBUSTION ENGINES HAVING GAS CHANGING VALVES ARRANGED ESSENTIALLY IN PARALLEL TO ONE ANOTHER

This invention is based on DE-C No. 23 42 530 wherein a timing case is provided for a cylinder head of an internal combustion engine having gas changing valves arranged essentially in parallel to one another that are actuated by separate cams on a joint cam shaft disposed in the timing case, by way of tappets that are guided in breakthroughs of the timing case, said breakthroughs being arranged adjacently while leaving a web, and the web, on the side of the cam shaft, being connected with the bottom part of a divided cam shaft bearing, the width of the cam shaft bearing, in the area of the smallest wall thickness of the web, exceeding the smallest wall thickness.

In the case of this known construction, the timing case is constructed in one piece with the cylinder head. In the case of this cylinder head, also at least two identical parallel gas changing valves are provided. The relatively short mutual distance of the parallel valves, on the one hand, and the endeavor provide to relatively large diameters for the bucket tappets, on the other hand, results in a relatively narrow web between the adjacent breakthroughs for guiding of the bucket tappets. In the case of a camshaft bearing that is arranged approximately in the center between the axes of identical valves of a combustion chamber and has a detachably fastened bearing bracket, the bottom part of the bearing that forms one piece with the timing case, when the breakthroughs are made that serve for the guiding of the bucket tappets, is cut at both opposite front sides to the wall thickness of the web. In order to eliminate the disadvantage of the friction bearing surface for a camshaft bearing collar that is reduced by the cutting of the bottom part of the bearing, this camshaft bearing is equipped with bearing bushes for the development of a perfect hydrodynamic lubricating film.

These bearing bushes represent additional structural elements, the cost of which increases with the number of cylinders and the number of camshafts of an internal-combustion engine. Since, in addition, when the cylindrical breakthroughs are made, on the one hand, and the bearing bore, on the other hand, the contours of cylinders penetrating one another at a right angle are made by cutting, there in the area of the intersections a working sequence with an interrupted cut. Therefore, at least in the case of the making of several aligned camshaft bearing bores that comply with the contour, an increased cost with respect to manufacturing is required.

The invention is based on the objective of indicating, for a timing case according to the prior art device as previously described having a camshaft bearing arranged between narrowly adjacent breakthroughs, a development in the case of which contours of cylinders penetrating one another at a right angle of camshaft bearing bores as well as breakthroughs and thus a machining of such intersections are avoided.

This objective is achieved in a timing case wherein the timing case is developed separate from the cylinder head, and wherein the breakthroughs disposed transversely with respect to the cam shaft bearing and approximately in the area of the smallest wall thickness of the web at a predetermined distance from the bearing surface in the bottom part of the bearing in such a way that on both sides of the web a bearing wall remains at the bottom part of the bearing that has the bearing surface, the bearing wall being integral with the web. By means of the first characteristic of the timing case constructed separately from the cylinder head, the breakthroughs serving for the guiding of the bucket tappets can advantageously by machined from the side facing away from the camshaft bearing. By means of this machining direction of the breakthroughs, it is in a further advantageous way, possible to construct the timing case according to other characteristics of the characterizing part. Accordingly, the bottom part of the camshaft bearing is cut by means of the narrowly adjacent breakthroughs, but these cuts end at a predetermined distance from the bearing surface in the bottom part of the bearing so that in the area of the cuts of the bottom part of the bearing, a bearing wall remains that extends on both sides of the web. By means of the resulting large bearing width in the bottom part of the bearing, the camshaft, without the insertion of bearing bushes, can be disposed directly in the timing case. Further, in the case of a lubricating-oil supply via a hollow camshaft having radial supply ducts to the bearing, its lubricating oil supply is ensured as well as the development of a perfect hydrodynamic lubricating film. Also, the lubricating-oil supply of the bearing can take place with the conventional amount at a known pressure so that the circulation of a larger amount of lubricating oil is avoided. When, on the other hand, instead of the direct disposing of the camshaft in the timing case, a disposing is to take place by means of bearing bushes arranged in the bearing bore, the bearing wall according to the invention has the advantage of a wide support of the arranged bearing bush by means of which damages to the bearing bush are avoided that are caused especially by edge pressure.

A bearing wall that, in the course between its front sides, is adapted to the width of the camshaft bearing, in an advantageous way, results in a reinforcement of the timing case. Especially advantageous for the reinforcing of the timing case is the one-piece connection of the bearing wall with the web between the breakthroughs. An additional reinforcement for the timing case is achieved by means of the fact that the web, by means of a continuously extending transition, is connected with each front side of the bearing wall.

According to a different objective of the invention, a step-shaped transition is connected to the web with a flat shoulder at the bearing wall.

This achieves an advantage that, for a valve control with an automatic play-compensating device, a valve gear element is held with a clearance to the base circle of a cam of the cam shaft by means of a machine-attached stop, which may be according to P No. 33 36 240.8, wherein the step-shaped shoulder is used as a machine-attached stop for a bucket tappet having a hydraulic valve-play balancing element. Thus, the bucket tappet, during the operation of the internal-combustion engine, in the base circle phase, can be kept away from the base circle, by means of which the friction loss in the valve gear is reduced. Also, a timing case is conceivable that is constructed of two parts, in which case the flat shoulders are located in the parting plane of the part comprising the camshaft bearing.

With the machining direction indicated according to the invention for the breakthrough from the direction of the side facing away from the camshaft bearing, the timing case according to the invention is suitable for being developed by means of diecasting. The reason is also that because of the absence according to the invention of the intersections of the breakthroughs with the part of the bearing bore in the bottom part of the bearing the drawing cores required in each case for this purpose do not interfere with one another. This is true not only for a timing case that as an individual part is developed for only two parallel valves. The invention also promotes the combining of several timing cases required in the case of a multi-cylinder internal-combustion engine to form a one-piece component in die-cast construction. By means of the reinforcing bonding as described above of the bearing wall and the web connecting in one piece, the timing case may be developed with relatively thin walls.

Finally, the bearing wall has the additional advantage to, via a circumferential groove in the bearing collar of the camshaft, provide injection bores supplied with lubricating oil in such a way that the slideways of the cams and bucket tappets are lubricated optimally. In such a case, the bearing wall in the area of the smallest wall thickness of the web, is penetrated by lubricating-oil bores that are directed approximately from the center of the bearing wall to the breakthroughs to achieve lubrication of a valve tappet in front of an ascending cam.

The foregoing and other objects, features, and advantages of the present invention will become more apparent from the following description when taken in connection with the accompanying drawings which show, for the purposes of illustration only, plural embodiments in accordance with the present invention, and wherein.

Figure 1:
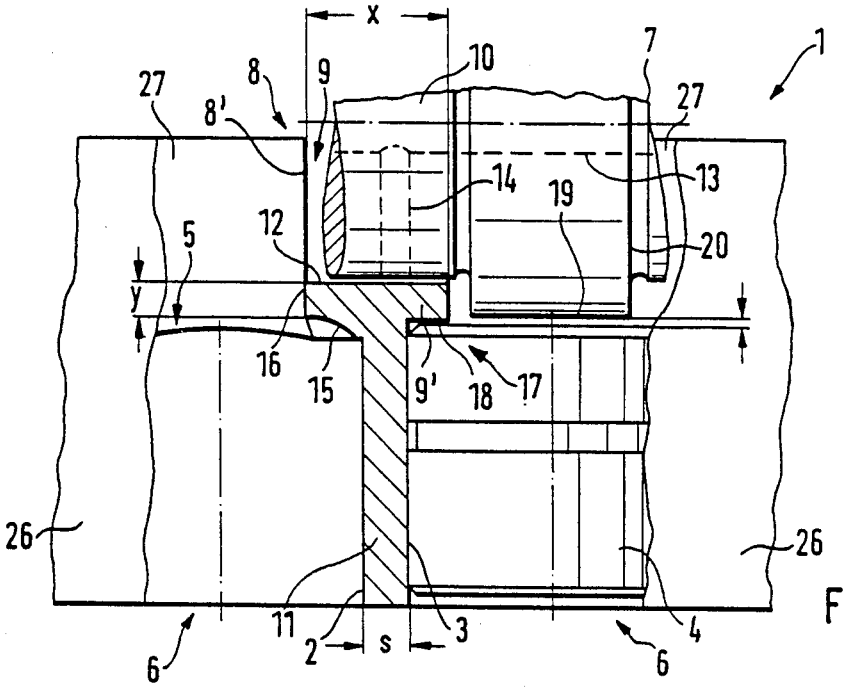
FIG. 1 is a timing case with two embodiments of the construction of a bearing wall of the camshaft bearing in the area of a web between two adjacent breakthroughs for the receiving of tappets.

Referring now to the drawings wherein like reference numerals are used to designate like parts and more particularly to FIG. 1, a timing case 1 is shown for the separate arrangement at a cylinder head, that is not shown, of a valve-controlled internal-combustion engine which comprises for a cylinder of the internal-combustion engine breakthroughs 2 and 3 arranged in groups for the receiving of valve tappets 4. The breakthroughs 2,3 are open at both ends 5, 6, namely in the direction of the cylinder head as well as in the direction of a camshaft 7. The camshaft 7 is guided in the timing case 1 by means of a bearing 8. The bearing 8 that is developed in two parts, in its bottom part 8', has a slide bearing bore 9 for a bearing collar 10 of the camshaft 7 that extends essentially over the width "x" of said bearing. In order to achieve a stiff valve gear, the bearing 8 is arranged between the breakthroughs 2, 3 for the tappets 4, in which case the tappets 4 interact with valves (21, 22 in FIG. 2) assigned to a cylinder. The bearing 8, in its bottom part 8', is connected with a web 11 between the breakthroughs 2 and 3 in the timing case 1. It is characterizing for said web 11 that it, in the case of a wall thickness "s" that is smaller than the width "x" of the bearing 8, by means of the closely moved-together breakthroughs 2, 3, on the side of the bearing, ends at a predetermined distance "y" from the bearing surface 12 of the slide bearing bore 9. Thus, in the area of the web 11, a bearing wall 9' is achieved, by means of which the slide bearing bore 9 in its axial course in the bottom part 8' of the bearing is maintained over the width "x" of the bearing 8. As a result, the bearing 8, via bores 13 and 14 in the camshaft 7 can be supplied perfectly with lubricating oil. In the case of tappets 4 that are equipped with hydraulic valve-play compensating elements, a larger clearance is obtained for this purpose in the case of the arrangement of supply ducts (not shown) in the timing case 1 as well as on the whole a simplified supply of oil to the bearing 8 as well as the valve-play compensating elements. By means of the invention, not only the largest possible bearing surface 12 is achieved in the lower part 8' of the bearing, but in the case of the cutting effected during final machining of the bearing bore, a tool cut is made that is free interruptions with the result of a precisely shaped slide bearing bore 9.

In the breakthrough 2, the web 11, by means of a continuously extending transition 15, is connected with a front side 16 of the bearing 8. The transition 15 may, for example, be shaped out of the timing case 1 developed as a die-cast part. Another development of the transition is shown in the breakthrough 3, in which case a step-shaped transition 17 having a flat shoulder 18 is connected to the web 11. This shoulder 18 can serve as a machine-attached stop, according to P No. 33 36 240.8, for a tappet 4 equipped with a hydraulic valve-play compensating element, by means of which the tappet 4, during the operation of the internal-combustion engine in the base circle phase is held with play to the base circle 19 of a cam 20 of the camshaft 7. As a result, friction losses are avoided in the base circle phase.

Figure 2:
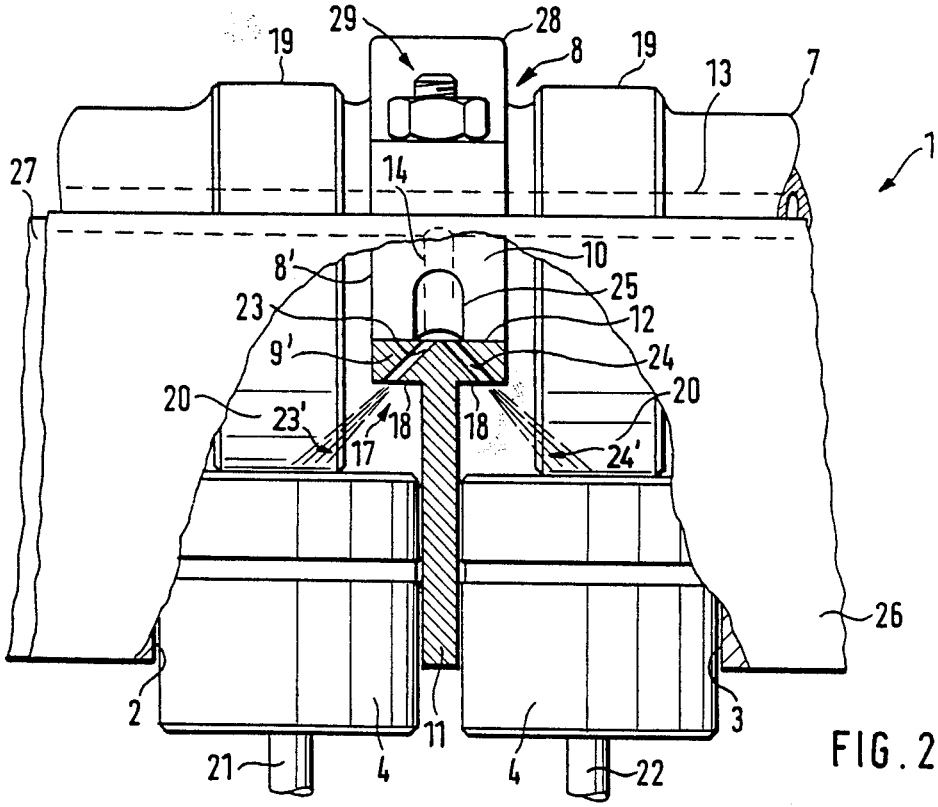
FIG. 2 is another embodiment of a timing case having lubricating-oil bores that are in addition arranged in the bearing wall and FIG. 3 in a schematic showing of the invention applied to a V-type engine at right angles to that of FIGS. 1 and 2.

In the case 1 of the timing case shown in FIG. 2, by means of the bearing wall 9' extending in the area of the smallest wall thickness of the web 11 to both its sides, lubricating oil bores 23, 24 penetrating the bearing wall 9' may be arranged in such a way that a lubricating-oil spray jets 23' and 24' at the tappet 4 is achieved in front of the respectively ascending cams 20 of the camshaft 7. The lubricating-oil bores 23, 24, penetrating the bearing wall 9' from approximately the center of the bearing wall 12 are in an oil-guiding connection with a partial circumferential groove 25 in the bearing collar 10 of the camshaft 7. The partial circumferential groove 25 itself is supplied with lubricating oil from the central bore 13 in the camshaft 7 via the radially directed bore 14.

Figure 3:
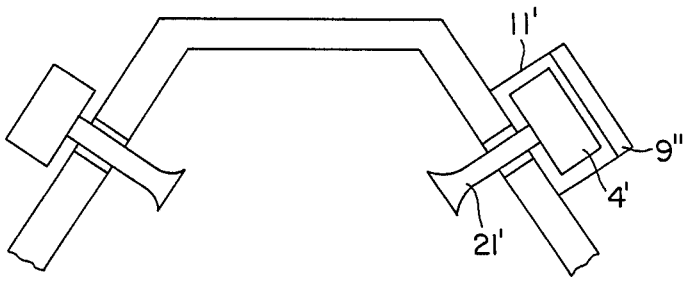

The timing case 1 may be provided as an individual part for two gas changing valves arranged in parallel. For a multicylinder internal-combustion engine having gas changing valves that are arranged in a row and are parallel in groups, the timing cases provided for one row of valves can be combined into a one-part structural component. For this combination, the individual timing cases 1, via the bottom parts 8' of their bearing, are in firm connection with longitudinal walls 26 and 27. For the detachable fastening of the timing case 1 that is developed separately from the cylinder head, the screwed connection 29 is used that is provided for a cap piece 28 of the camshaft bearing 8 and is anchored in the cylinder head. The timing case 1 is used preferably in the case of a multi-cylinder internal-combustion engine having valves that are arranged in V-shape shown schematically in FIG. 3 wherein the web 11' of the timing case with its bearing wall 9'' is shown adjacent tappet 4' and valve 21' of the right hand bank if cylinders and in a row in pairs in a cylinder head with connecting surfaces that are developed at a right angle with respect to the valves for the detachably fastened timing case assigned to each row of valves.

While I have shown and described plural embodiments in accordance with the present invention, it is understood that the same is not limited thereto but is susceptible to numerous changes and modifications as known to one having ordinary skill in the art, and I therefore do not wish to be limited to the details shown and described herein, but intend to cover all such modifications as are encompassed by the scope of the appended claims.

What is claimed is:

1. A timing case for a cylinder head of internal-combustion engines having gas changing valves arranged essentially in parallel to one another that are actuated by separate cams on a single camshaft disposed in the timing case, via tappets that are guided by breakthroughs of the timing case, said breakthroughs being arranged adjacently while leaving a web, and said web, on a side of the camshaft being connected with a bottom part of a divided camshaft bearing, an axial width of said camshaft bearing in an area of the smallest wall thickness of the web, exceeding said smallest wall thickness, wherein the timing case is developed separately from the cylinder head, and wherein the breakthroughs disposed transversely with respect to the camshaft bearing end approximately in the area of the smallest wall thickness of the web at a predetermined distance from the bearing surface in the bottom part of the bearing in such a way that on both sides of the web a bearing wall remains at the bottom part of the bearing that has said bearing surface, said bearing wall being integral with the web.

2. A timing case according to claim 1, wherein the web, by means of a continuously extending transition, is connected with each axial end of the bearing wall.

3. A timing case according to claim 1, wherein a step-shaped transition connects to the web that has a flat shoulder at the bearing wall.

4. A timing case according to claim 3, for a valve control with an automatic play-compensating device, a valve gear element being held with a clearance to a base circle of a cam of the camshaft by means of said flat shoulder used as a stop.

5. A timing case according to claim 1, wherein the bearing wall in the area of the smallest wall thickness of the web is penetrated by lubricating oil bores that are directed approximately from the center of the bearing wall to the breakthroughs to achieve lubrication of a valve tappet in front of an ascending cam.

6. A multi-cylinder internal combustion engine having said gas changing valves arranged in a row, wherein a timing case assembly provided for one row of valves comprises a plurality of timing cases according to claim 1 combined into a one-piece structural component.

7. A multi-cylinder internal combustion engine having said valves arranged in a V-shape in pairs in a row in said cylinder head, said cylinder head having a connecting surface arranged at a right angle with respect to at least one of the valves for detachably fastenting at least one timing case according to claim 1 assigned to each row of valves.

* * * * *